US009163838B2

(12) United States Patent
Takiguchi et al.

(10) Patent No.: US 9,163,838 B2
(45) Date of Patent: Oct. 20, 2015

(54) GAS TURBINE COMBUSTION BURNER

(75) Inventors: Satoshi Takiguchi, Tokyo (JP); Shinji Akamatsu, Tokyo (JP); Kenji Sato, Tokyo (JP); Naoki Abe, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 511 days.

(21) Appl. No.: 13/395,763

(22) PCT Filed: Nov. 8, 2010

(86) PCT No.: PCT/JP2010/069794

§ 371 (c)(1),
(2), (4) Date: Mar. 13, 2012

(87) PCT Pub. No.: WO2011/055815

PCT Pub. Date: May 12, 2011

(65) Prior Publication Data

US 2012/0167569 A1 Jul. 5, 2012

(30) Foreign Application Priority Data

Nov. 9, 2009 (JP) ..... 2009-256074

(51) Int. Cl.
*F23R 3/14* (2006.01)
*F23R 3/28* (2006.01)
*F23R 3/36* (2006.01)

(52) U.S. Cl.
CPC . *F23R 3/14* (2013.01); *F23R 3/286* (2013.01); *F23R 3/36* (2013.01);
(Continued)

(58) Field of Classification Search
CPC ..... F23C 2900/07001
USPC ..... 60/737, 740, 742, 746, 748; 239/399, 239/400
See application file for complete search history.

(56) References Cited

U.S. PATENT DOCUMENTS 5,438,834 A * 8/1995 Vuillamy et al. ..... 60/753
2009/0183511 A1* 7/2009 Dinu ..... 60/737

FOREIGN PATENT DOCUMENTS

CN 1384908 A 12/2002
CN 101055093 A 10/2007
(Continued)

OTHER PUBLICATIONS

Bill Gunston, Cambridge Aerospace Dictionary, 2009, Cambridge University Press, 2nd Edition, p. 115.*
(Continued)

*Primary Examiner* — Phutthiwat Wongwian
*Assistant Examiner* — Marc Amar
(74) *Attorney, Agent, or Firm* — Westerman, Hattori, Daniels & Adrian, LLP

(57) ABSTRACT

Provided is a gas turbine combustion burner capable of uniformly ejecting fuel from ejection holes for reduced $NO_x$ emissions of gas turbine combustors. The gas turbine combustion burner includes a plurality of swirling vanes (20) for ejecting fuel from fuel ejection holes (23, 24) into air or a mixture of air and fuel flowing from an upstream side while applying a swirling force to form a swirling mixed airflow and a nozzle (21) having the swirling vanes (20) arranged radially on an outer circumferential surface thereof and having a first fuel passage (26), through which the fuel is guided to the fuel ejection holes (23, 24), provided therein, a cavity (25) communicating with the fuel ejection holes (23, 24) is provided in each swirling vane (20), and at least two second fuel passages (27) are provided between the cavity (25) and the first fuel passage (26) along an axial direction.

8 Claims, 7 Drawing Sheets

(52) U.S. Cl.
CPC ..... *F23C 2900/07001* (2013.01); *F23D 2900/00008* (2013.01); *F23D 2900/14004* (2013.01); *F23D 2900/14701* (2013.01)

(56) References Cited

FOREIGN PATENT DOCUMENTS

| | | | | |
|---|---|---|---|---|
| CN | 101487595 | A | | 7/2009 |
| GB | 2008732 | A | * | 6/1979 |
| JP | 06-063647 | B2 | | 8/1994 |
| JP | 06-221560 | A | | 8/1994 |
| JP | 2003-042453 | A | | 2/2003 |
| JP | 2003-074855 | A | | 3/2003 |
| JP | 3494753 | B2 | | 2/2004 |
| JP | 2009-168439 | A | | 7/2009 |

OTHER PUBLICATIONS

A Korean Decision to Grant a Patent dated Jan. 28, 2014 issued in Korean Application No. 10-2012-7006906, with partial English Translation. (3 pages).

International Search Report of PCT/JP2010/069794, dated Jan. 25, 2011.

Chinese Office Action dated Dec. 2, 2013, issued in corresponding Chinese Patent Application No. 201080042652.1 with English translation (13 pages).

Chinese Notice of Allowance dated Oct. 22, 2014, issued in corresponding Chinese Patent Application No. 2010800426521, (2 pages), the Notice of Allowance has been received.

* cited by examiner

GAS TURBINE COMBUSTION BURNER

TECHNICAL FIELD

The present invention relates to gas turbine combustion burners having swirling vanes (swirler vanes) for ejecting fuel from fuel ejection holes into air or a mixture of air and fuel flowing from the upstream side while applying a swirling force to form a swirling mixed airflow.

BACKGROUND ART

A known example of this type of gas turbine combustion burner is disclosed in PTL 1.

CITATION LIST

Patent Literature

PTL 1

Japanese Unexamined Patent Application, Publication No. 2003-74855

SUMMARY OF INVENTION

Technical Problem

However, the combustion burner disclosed in PTL 1 above has a problem in that fuel flowing through gas fuel passages (fuel passages) 8 into gas fuel passage portions (cavities) 16 provided inside swirlers (swirling vanes) 14 forms vortices in the gas fuel passage portions 16, and the vortices create a pressure gradient in the gas fuel passage portions 16, thus leading to varying amounts of fuel ejected from small holes (ejection holes) 15.

An object of the present invention, which has been made in light of the above circumstances, is to provide a gas turbine combustion burner capable of uniformly ejecting fuel from ejection holes for reduced $NO_x$ emissions of gas turbine combustors.

Solution to Problem

To solve the above problem, the present invention employs the following solutions.

A gas turbine combustion burner according to a first aspect of the present invention is a gas turbine combustion burner that includes a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, provided therein, a cavity communicating with the fuel ejection holes is provided in each swirling vane, and at least two second fuel passages are provided between the cavity and the first fuel passage along an axial direction.

In the gas turbine combustion burner according to the first aspect of the present invention, the fuel guided (supplied) through the first fuel passage toward the swirling vanes is guided through at least two (the plurality of) second fuel passages to the cavities and is ejected (jetted) from the fuel ejection holes. As the fuel passes through the second fuel passages, dynamic pressure generated in the first fuel passage is dispersed so that the fuel flows (is supplied) evenly (uniformly) from the individual second fuel passages into the cavities, thus preventing the formation of vortices in the cavities.

This allows uniform ejection of the fuel from the fuel ejection holes, thus contributing to reduced $NO_x$ emissions of gas turbine combustors.

A gas turbine combustion burner according to a second aspect of the present invention is a gas turbine combustion burner that includes a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, provided therein, a cavity communicating with the fuel ejection holes is provided in each swirling vane, a single second fuel passage is provided between the cavity and the first fuel passage along an axial direction, and a rectifier grid is disposed at an exit or entrance end of the second fuel passage.

In the gas turbine combustion burner according to the second aspect of the present invention, the fuel guided (supplied) through the first fuel passage toward the swirling vanes is guided through the single second fuel passage and the rectifier grids to the cavities and is ejected (jetted) from the fuel ejection holes. As the fuel passes through the second fuel passages and the rectifier grids, dynamic pressure generated in the first fuel passage is dispersed so that the fuel flows (is supplied) evenly (uniformly) from the second fuel passages into the cavities, thus preventing the formation of vortices in the cavities. This allows uniform ejection of the fuel from the fuel ejection holes, thus contributing to reduced $NO_x$ emissions of gas turbine combustors.

A gas turbine combustion burner according to a third aspect of the present invention is a gas turbine combustion burner that includes a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, provided therein, a cavity communicating with the fuel ejection holes is provided in each swirling vane, a single second fuel passage is provided between the cavity and the first fuel passage along an axial direction, and a pressure loss member is disposed in the first fuel passage near the upstream side of the second fuel passage.

In the gas turbine combustion burner according to the third aspect of the present invention, the fuel guided (supplied) through the first fuel passage toward the swirling vanes is guided through the single second fuel passage and the pressure loss member to the cavities and is ejected (jetted) from the fuel ejection holes. As the fuel passes through the second fuel passages and the pressure loss member, dynamic pressure generated in the first fuel passage is dispersed so that the fuel flows (is supplied) evenly (uniformly) from the second fuel passages into the cavities, thus preventing the formation of vortices in the cavities. This allows uniform ejection of the fuel from the fuel ejection holes, thus contributing to reduced $NO_x$ emissions of gas turbine combustors.

A gas turbine combustor according to a fourth aspect of the present invention includes any one of the above gas turbine combustion burners.

The gas turbine combustor according to the fourth aspect of the present invention includes a gas turbine combustion burner capable of uniformly ejecting fuel from ejection holes, thus contributing to reduced $NO_x$ emissions of the gas turbine combustor.

Advantageous Effects of Invention

The gas turbine combustion burners according to the present invention provide the advantage of uniformly ejecting fuel from the ejection holes, thus contributing to reduced $NO_x$ emissions of gas turbine combustors.

DESCRIPTION OF EMBODIMENTS

Figure 1:
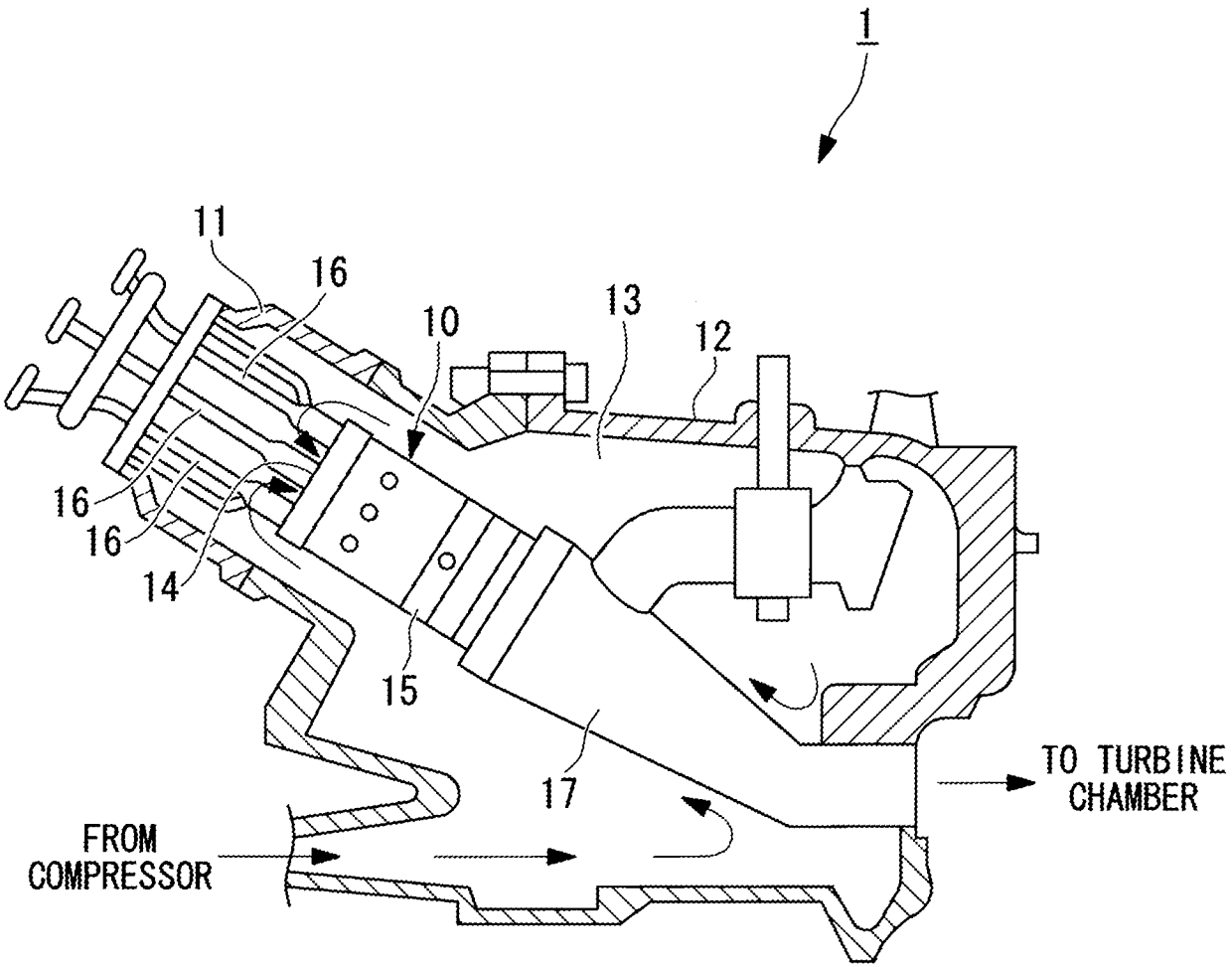
FIG. 1 is a schematic structural diagram showing a gas turbine combustor including gas turbine combustion burners according to the present invention.
Figure 2:
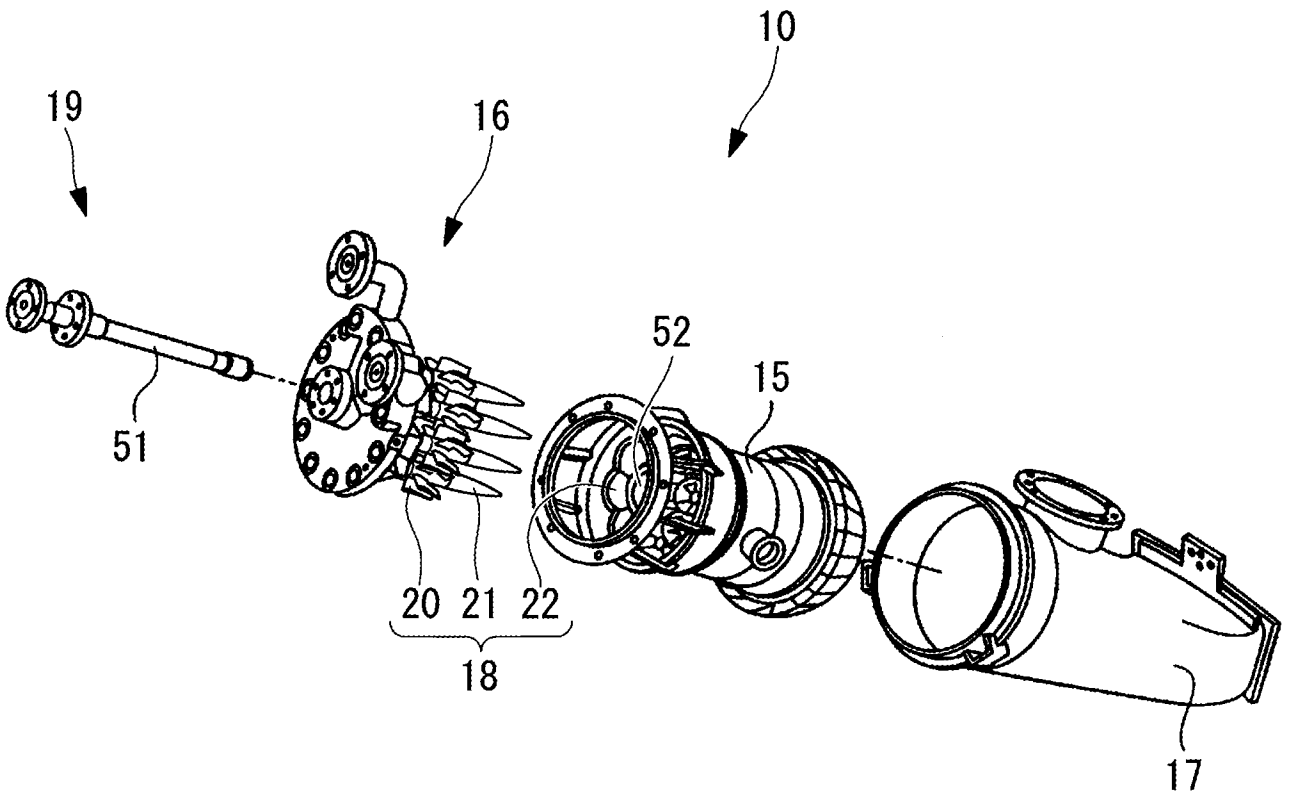
FIG. 2 is a perspective view showing the gas turbine combustor shown in FIG. 1, showing fuel nozzles, an inner cylinder, and a tailpipe in an exploded view.
Figure 3:
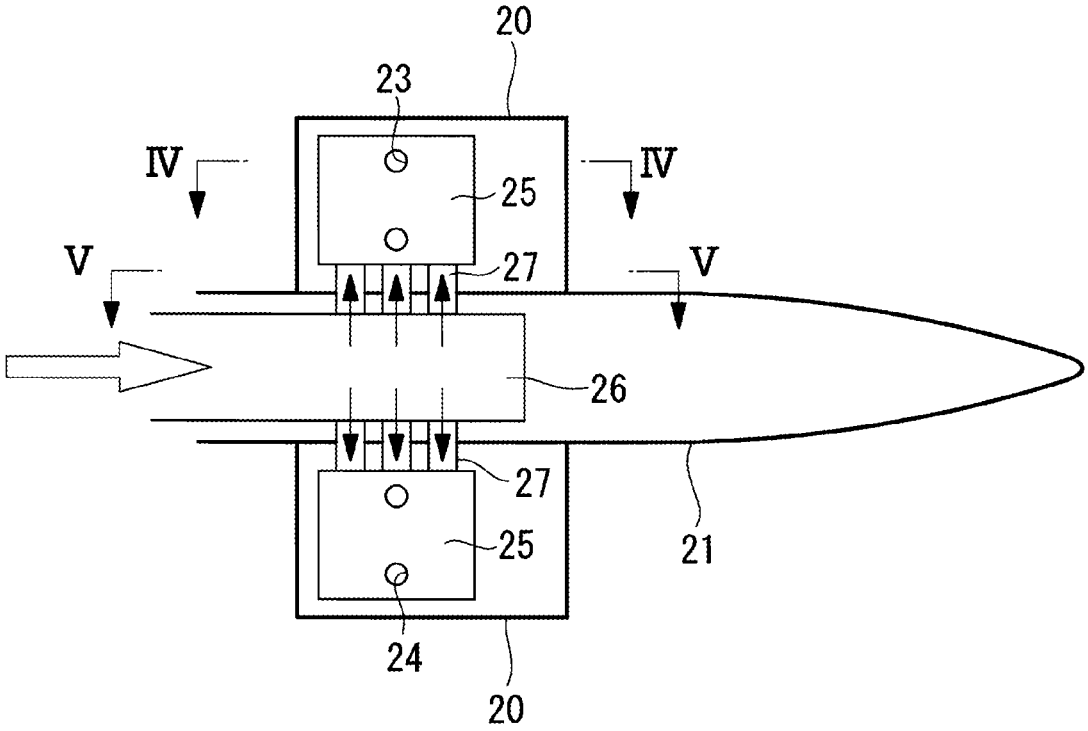
FIG. 3 is a sectional view showing, in magnified view, a relevant part of a gas turbine combustion burner according to a first embodiment of the present invention.
Figure 4:
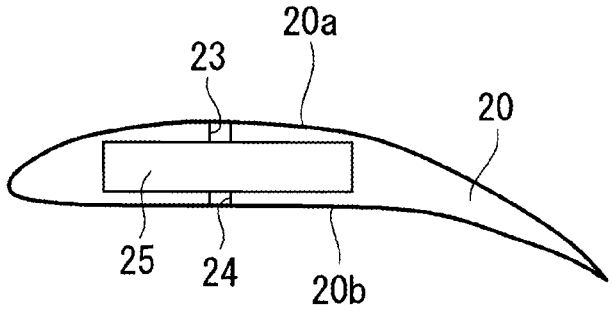
FIG. 4 is a sectional view as viewed along arrow IV-IV in FIG. 3.
Figure 5:
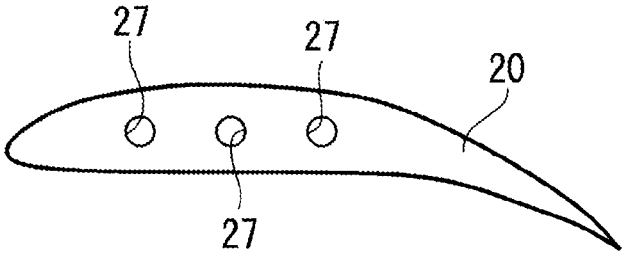
FIG. 5 is a sectional view as viewed along arrow V-V in FIG. 3.

A gas turbine combustion burner according to a first embodiment of the present invention will be described below with reference to FIGS. 1 to 5. FIG. 1 is a schematic structural diagram showing a gas turbine combustor including gas turbine combustion burners according to the present invention; FIG. 2 is a perspective view showing the gas turbine combustor shown in FIG. 1, showing fuel nozzles, an inner cylinder, and a tailpipe in an exploded view; FIG. 3 is a sectional view showing, in magnified view, a relevant part of a gas turbine combustion burner according to this embodiment; FIG. 4 is a sectional view as viewed along arrow IV-IV in FIG. 3; and FIG. 5 is a sectional view as viewed along arrow V-V in FIG. 3.

A gas turbine 1 (see FIG. 1) including gas turbine combustors (hereinafter referred to as "combustors") 10 shown in FIGS. 1 and 2 includes a compressor (not shown) and a turbine (not shown) in addition to the combustors 10. Most gas turbines include a plurality of combustors 10; they mix air compressed by the compressor (compressed air) with fuel supplied to the combustors 10 and combust it in the individual combustors 10, thereby producing high-temperature combustion gas. This high-temperature combustion gas is supplied to the turbine to rotate and drive the turbine.

As shown in FIG. 1, the plurality of combustors 10 are arranged in a circle in a combustor casing 11 (only one of them is shown in FIG. 1). The combustor casing 11 and a gas turbine casing 12 are filled with compressed air, forming a chamber 13. The air compressed by the compressor is introduced into the chamber 13. The introduced compressed air enters the combustor 10 through an air inlet 14 provided in an upstream portion of the combustor 10. In an inner cylinder 15 of the combustor 10, fuel supplied from a combustion burner 16 is mixed with the compressed air and is combusted. Combustion gas produced by combustion is supplied through a tailpipe 17 to a turbine chamber to rotate a turbine rotor (not shown).

FIG. 2 is a perspective view showing the combustion burner 16, the inner cylinder 15, and the tailpipe 17 in an exploded view.

As shown in FIG. 2, the combustion burner 16 includes a plurality of main combustion burners (gas turbine combustion burners) 18 and a single pilot combustion burner (gas turbine combustion burner) 19.

As shown in FIG. 2, the plurality of main combustion burners 18 are disposed in the inner cylinder 15 so as to surround the pilot combustion burner 19. Fuel ejected from the main combustion burners 18 is premixed with a swirling flow of air through swirling vanes (swirler vanes) 20 of the main combustion burners 18 and is combusted in the inner cylinder 15.

The main combustion burners 18 are each composed mainly of a main fuel nozzle (hereinafter referred to as "main nozzle") 21, a main burner cylinder 22, and swirling vanes 20.

The main burner cylinder 22 is disposed concentrically with the main nozzle 21 so as to surround the main nozzle 21. Thus, the outer circumferential surface of the main nozzle 21 and the inner circumferential surface of the main burner cylinder 22 form an annular air passage (not shown) through which the compressed air (not shown) flows from the upstream side to the downstream side.

A plurality of (in this embodiment, six) swirling vanes 20 are arranged radially from the outer circumferential surface of the main nozzle 21 along the axial direction of the main nozzle 21.

As shown in FIGS. 4 and 5, the swirling vanes 20 are streamlined members having a wing shape in section view; they apply a swirling force to the compressed air flowing through the air passage formed between the outer circumferential surface of the main nozzle 21 and the inner circumferential surface of the main burner cylinder 22, thereby changing the compressed air to a swirling airflow.

As shown in FIG. 4, a plurality of (in this embodiment, two) (fuel) ejection holes 23 are formed through a dorsal surface 20*a* of each swirling vane 20 in the thickness direction, and a plurality of (in this embodiment, two) (fuel) ejection holes 24 are formed through a ventral surface 20*b* of each swirling vane 20 in the thickness direction. A cavity 25 communicating with the ejection holes 23 and 24 is provided in each swirling vane 20, and a (first) fuel passage 26 (see FIG. 3) is provided in the main nozzle 21. The cavity 25 communicates with the fuel passage 26 through a plurality of (in this embodiment, three) (second) fuel passages 27 (see FIGS. 3 and 5) such that fuel is supplied through the fuel passages 26 and 27 and the cavities 25 to the ejection holes 23 and 24. The fuel ejected from the ejection holes 23 and 24 is mixed with the compressed air, and the fuel gas is supplied to the inner space of the inner cylinder 15 and is combusted.

In the main combustion burner 18 according to this embodiment, the fuel guided (supplied) through the fuel passage 26 toward the swirling vanes 20 is guided through the plurality of fuel passages 27 to the cavities 25 and is ejected (jetted) from the ejection holes 23 and 24. As the fuel passes through the fuel passages 27, dynamic pressure generated in the fuel passage 26 is dispersed so that the fuel flows (is supplied) evenly (uniformly) from the individual fuel passages 27 into the cavities 25, thus preventing the formation of vortices in the cavities 25.

This allows uniform ejection of the fuel from the ejection holes 23 and 24, thus contributing to reduced $NO_x$ emissions of the combustor 10.

Figure 6:
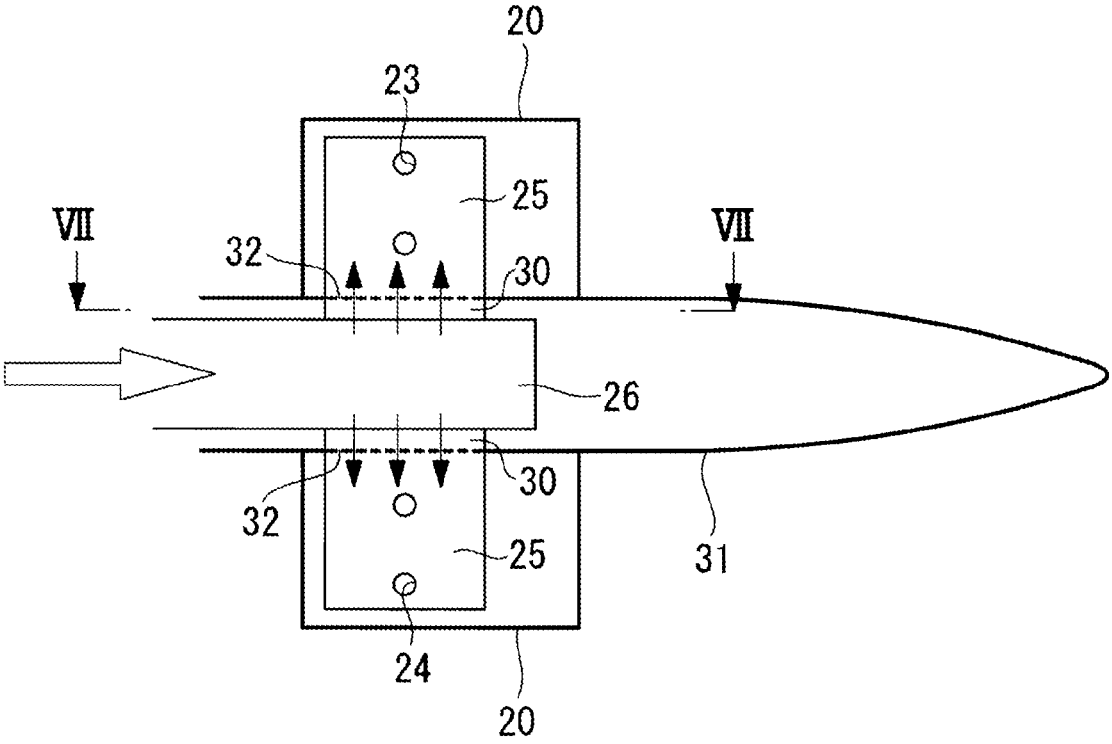
FIG. 6 is a sectional view showing, in magnified view, a relevant part of a gas turbine combustion burner according to a second embodiment of the present invention.

A second embodiment of a gas turbine combustion burner according to the present invention will now be described with reference to FIGS. 6 and 7. FIG. 6 is a sectional view showing, in magnified view, a relevant part of the gas turbine combustion burner according to this embodiment, and FIG. 7 is a sectional view as viewed along arrow VII-VII in FIG. 6.

The main combustion burner 18 (gas turbine combustion burner) according to this embodiment differs from that of the first embodiment described above in that it includes a main nozzle 31 having a single (second) fuel passage 30 instead of the plurality of fuel passages 27 shown in FIGS. 3 and 5. The other elements are the same as those of the first embodiment described above; a description of these elements will be omitted here.

The same members as those of the first embodiment described above are designated by the same reference signs.

Figure 7:
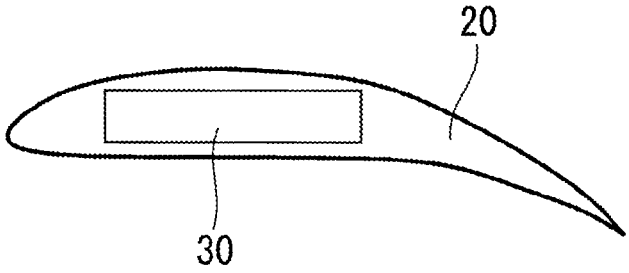
FIG. 7 is a sectional view as viewed along arrow VII-VII in FIG. 6.

As shown in FIGS. 6 and 7, each cavity 25 communicates with the fuel passage 26 through, for example, a single second fuel passage 30 having the same passage cross-section as the cavity 25, and a rectifier grid 32 is disposed at an exit end (or entrance end) of the fuel passage 30.

In the main combustion burner 18 according to this embodiment, the fuel guided (supplied) through the fuel passage 26 toward the swirling vanes 20 is guided through the fuel passages 30 and the rectifier grids 32 to the cavities 25 and is ejected (jetted) from the ejection holes 23 and 24. As the fuel passes through the fuel passages 30 and the rectifier grids 32, dynamic pressure generated in the fuel passage 26 is dispersed so that the fuel flows (is supplied) evenly (uniformly) from the fuel passages 30 into the cavities 25, thus preventing the formation of vortices in the cavities 25.

This allows uniform ejection of the fuel from the ejection holes 23 and 24, thus contributing to reduced $NO_x$ emissions of the combustor 10.

Figure 8:
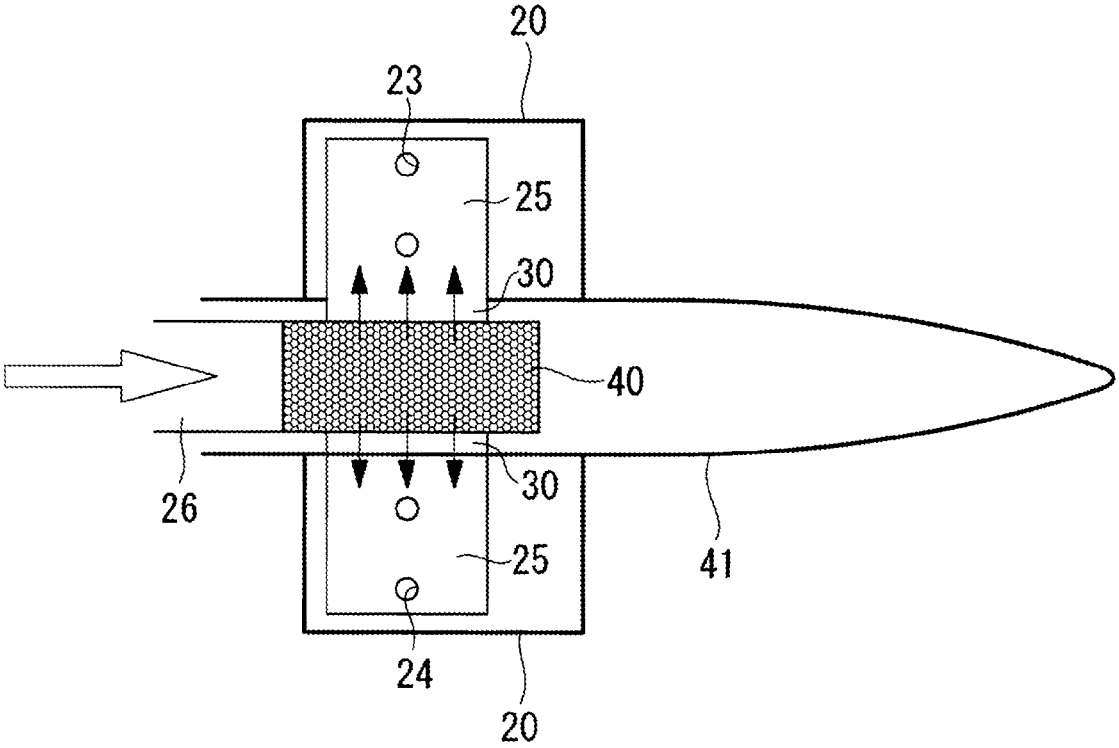
FIG. 8 is a sectional view showing, in magnified view, a relevant part of a gas turbine combustion burner according to a third embodiment of the present invention.

A third embodiment of a gas turbine combustion burner according to the present invention will now be described with reference to FIG. 8. FIG. 8 is a sectional view showing, in magnified view, a relevant part of the gas turbine combustion burner according to this embodiment.

The main combustion burner (gas turbine combustion burner) 18 according to this embodiment differs from that of the second embodiment described above in that it includes a main nozzle 41 having a pressure loss member 40 instead of the rectifier grids 32 shown in FIG. 6. The other elements are the same as those of the second embodiment described above; a description of these elements will be omitted here.

The same members as those of the second embodiment described above are designated by the same reference signs.

As shown in FIG. 8, for example, a pressure loss member 40 formed of a porous material is disposed at the end (downstream end) of the fuel passage 26 such that the fuel flowing from the upstream side of the fuel passage 26 is supplied through the pressure loss member 40 and the fuel passages 30 to the cavities 25.

In the main combustion burner 18 according to this embodiment, the fuel guided (supplied) through the fuel passage 26 toward the swirling vanes 20 is guided through the fuel passages 30 and the pressure loss member 40 to the cavities 25 and is ejected (jetted) from the ejection holes 23 and 24. As the fuel passes through the fuel passages 30 and the pressure loss member 40, dynamic pressure generated in the fuel passage 26 is dispersed so that the fuel flows (is supplied) evenly (uniformly) from the fuel passages 30 into the cavities 25, thus preventing the formation of vortices in the cavities 25.

This allows uniform ejection of the fuel from the ejection holes 23 and 24, thus contributing to reduced $NO_x$ emissions of the combustor 10.

The present invention is not limited to the above embodiments and can also be applied to the pilot combustion burner 19.

Figure 9:
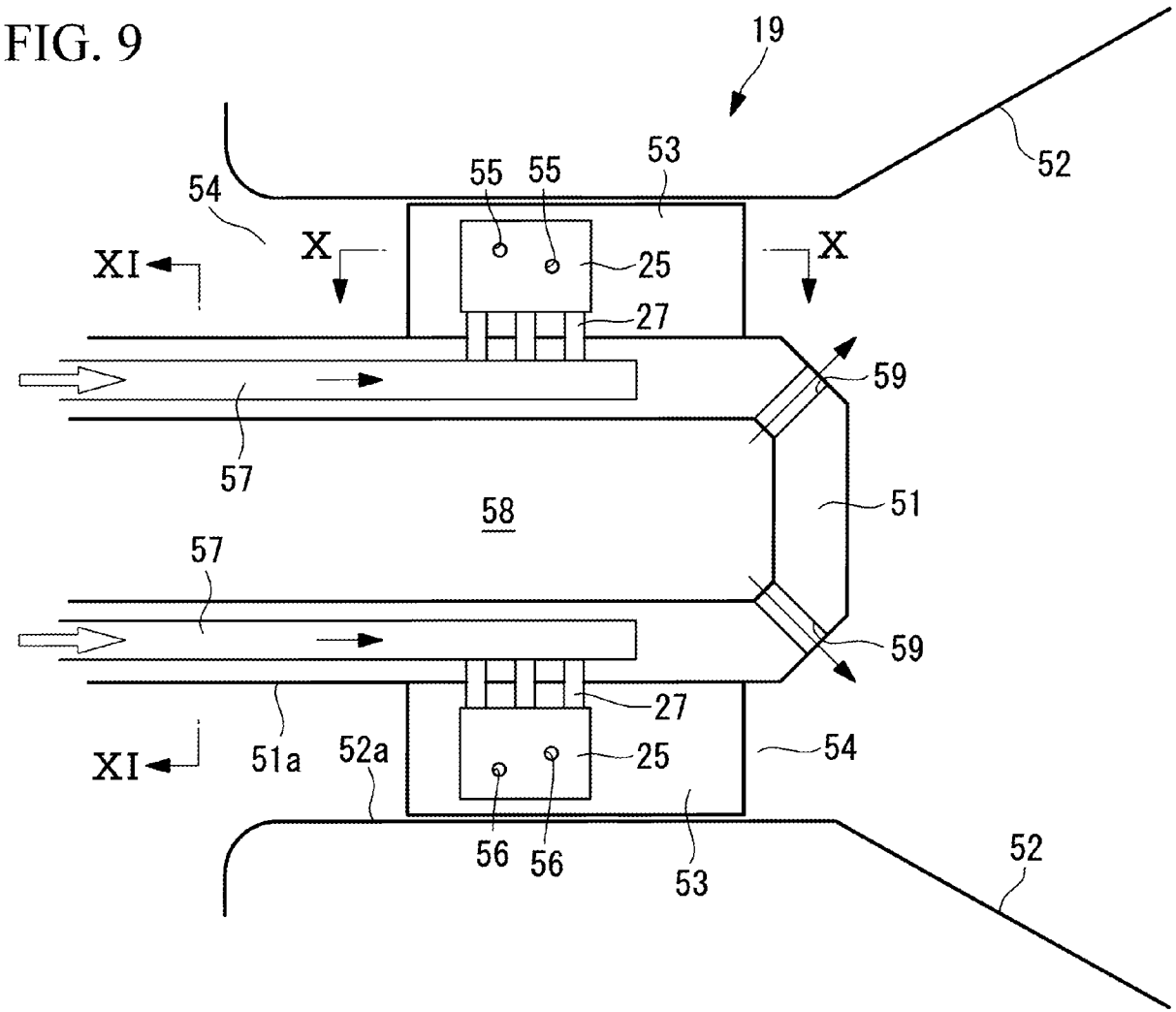
FIG. 9 is a sectional view showing, in magnified view, a relevant part of a gas turbine combustion burner according to another embodiment of the present invention.

As shown in FIG. 2 or 9, the pilot combustion burner 19 is composed mainly of a pilot combustion nozzle (hereinafter referred to as "pilot nozzle") 51, a pilot burner cylinder 52, and swirling vanes (swirler vanes) 53.

The pilot burner cylinder 52 is disposed concentrically with the pilot nozzle 51 such that its base end (left end in FIG. 9) surrounds the leading end (right end in FIG. 9) of the pilot nozzle 51. Thus, the outer circumferential surface 51*a* of the leading end of the pilot nozzle 51 and the inner circumferential surface 52*a* of the base end of the pilot burner cylinder 52 form an annular air passage 54 through which the compressed air (not shown) flows from upstream (to the left in FIG. 9) to downstream (to the right in FIG. 9).

Here, for simplicity of illustration, the swirling vanes 53 are not shown in FIG. 2.

A plurality of (in this embodiment, eight) swirling vanes 53 are arranged radially from the outer circumferential surface 51*a* of the leading end of the pilot nozzle 51 along the axial direction of the pilot nozzle 51.

Figure 10:
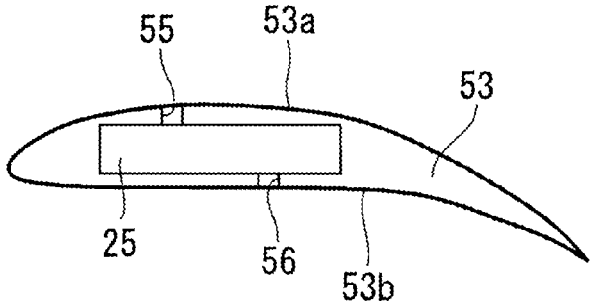
FIG. 10 is a sectional view as viewed along arrow X-X in FIG. 9.

As shown in FIG. 10, the swirling vanes 53 are streamlined members having a wing shape in section view; they apply a swirling force to the compressed air flowing through the air passage 54 formed between the outer circumferential surface 51*a* of the leading end of the pilot nozzle 51 and the inner circumferential surface 52*a* of the base end of the pilot burner cylinder 52, thereby changing the compressed air to a swirling airflow.

Figure 11A:
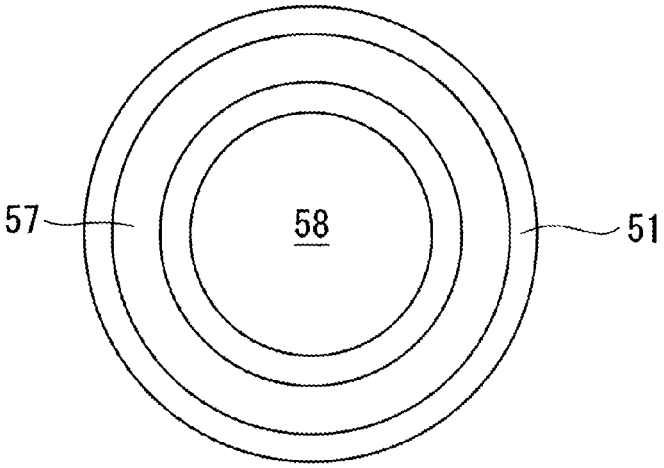
FIG. 11A is a sectional view as viewed along arrow XI-XI in FIG. 9.
Figure 11B:
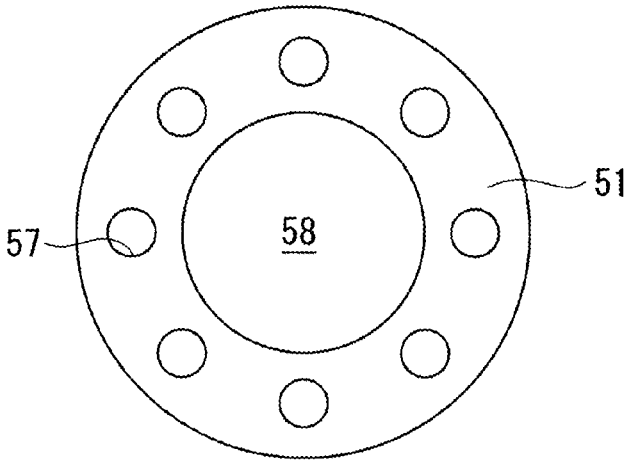
FIG. 11B is a sectional view as viewed along arrow XI-XI in FIG. 9.

As shown in FIG. 9 or 10, a plurality of (for example, two) (fuel) ejection holes 55 are formed through a dorsal surface 53*a* of each swirling vane 53 in the thickness direction, and a plurality of (for example, two) (fuel) ejection holes 56 are formed through a ventral surface 53*b* of each swirling vane 53 in the thickness direction. A cavity 25 communicating with the ejection holes 55 and 56 is provided in each swirling vane 53, and a single fuel passage 57 (for premixed combustion) having an annular shape in sectional view, as shown in FIG. 11A, or a plurality of (in this embodiment, eight) fuel passages 57 (for premixed combustion) having a circular shape in sectional view, as shown in FIG. 11B, are provided in the pilot nozzle 51. The cavity 25 communicates with the (first) fuel passage 57 through the fuel passages 27, described in the first embodiment, such that fuel is supplied through the fuel passages 57 and 27 and the cavities 25 to the ejection holes 55 and 56. The fuel ejected from the ejection holes 55 and 56 is mixed with the compressed air, and the fuel gas is supplied to the inner space of the inner cylinder 15 and is combusted.

A fuel passage 58 (for premixed combustion) separate from the fuel passage 57 is provided in the center of the pilot nozzle 51 located radially inside the fuel passage 57 such that the fuel supplied through the (third) fuel passage 58 is ejected from a plurality of (fuel) ejection holes 59 provided at the end of the pilot nozzle 51, is supplied to the inner space of the inner cylinder 15, and is combusted.

REFERENCE SIGNS LIST

10 combustor (gas turbine combustor)
18 main combustion burner (gas turbine combustion burner)
19 pilot combustion burner (gas turbine combustion burner)
20 swirling vane
21 main nozzle (nozzle)
23 ejection hole (fuel ejection hole)
24 ejection hole (fuel ejection hole)
25 cavity
26 fuel passage (first fuel passage)
27 fuel passage (second fuel passage)
30 fuel passage (a single second fuel passage)
31 main nozzle (nozzle)
32 rectifier grid
40 pressure loss member
41 main nozzle (nozzle)
51 pilot nozzle (nozzle)
53 swirling vane
55 ejection hole (fuel ejection hole)
56 ejection hole (fuel ejection hole)
57 fuel passage (first fuel passage)

The invention claimed is:

1. A gas turbine combustion burner comprising a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, is provided in the nozzle, wherein a cavity communicating with the fuel ejection holes is provided in each swirling vane, and at least two second fuel passages are provided between the cavity and the first fuel passage along an axial direction, and wherein a nozzle tip of the nozzle having a closed end.

2. A gas turbine combustor comprising the gas turbine combustion according to claim 1.

3. The gas turbine combustion burner according to claim 1, wherein the nozzle having a third fuel passage to provide fuel to fuel ejection holes provided near the nozzle tip of the nozzle.

4. A gas turbine combustor comprising the gas turbine combustion burner according to claim 3.

5. A gas turbine combustion burner comprising a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, is provided in the nozzle, wherein a cavity communicating with the fuel ejection holes is provided in each swirling vane, a single second fuel passage is provided between the cavity and the first fuel passage along an axial direction, and a rectifier grid is disposed at an exit or entrance end of the second fuel passage, the rectifier grid, which is disposed at the exit or entrance end of the second fuel passage, is provided in the nozzle to direct the flow of fuel to the cavity of the swirling vane, wherein when the fuel passes through the second fuel passage and the rectifier grid, dynamic pressure generated in the first fuel passage is dispersed so that the fuel flows evenly from the second fuel passage into the cavity for preventing a formation of vortices in the cavity.

6. A gas turbine combustor comprising the gas turbine combustion according to claim 5.

7. A gas turbine combustion burner comprising a plurality of swirling vanes for ejecting fuel from fuel ejection holes into air or a mixture of air and fuel flowing from an upstream side while applying a swirling force to form a swirling mixed airflow and a nozzle having the swirling vanes arranged radially on an outer circumferential surface thereof and having a first fuel passage, through which the fuel is guided to the fuel ejection holes, is provided in the nozzle, wherein a cavity communicating with the fuel ejection holes is provided in each swirling vane, a single second fuel passage is provided between the cavity and the first fuel passage along an axial direction, and a pressure loss member is disposed inside the first fuel passage near the upstream side of the single second fuel passage so that the fuel flowing from the first fuel passage flows through the pressure loss member before flowing into the single second fuel passage.

8. A gas turbine combustor comprising the gas turbine combustion according to claim 7.

* * * * *